US012669297B2

(12) United States Patent
Matsusaka

(10) Patent No.: US 12,669,297 B2
(45) Date of Patent: Jun. 30, 2026

(54) CUP-PLATE TYPE HEAT EXCHANGER

(71) Applicant: T.RAD CO., LTD., Tokyo (JP)

(72) Inventor: Shuhei Matsusaka, Tokyo (JP)

(73) Assignee: T.RAD CO., LTD., Tokyo (JP)

( * ) Notice: Subject to any disclaimer, the term of this patent is extended or adjusted under 35 U.S.C. 154(b) by 115 days.

(21) Appl. No.: 18/713,823

(22) PCT Filed: Nov. 25, 2022

(86) PCT No.: PCT/JP2022/044642
§ 371 (c)(1),
(2) Date: May 28, 2024

(87) PCT Pub. No.: WO2023/095930
PCT Pub. Date: Jun. 1, 2023

(65) Prior Publication Data
US 2025/0035385 A1 Jan. 30, 2025

(30) Foreign Application Priority Data
Nov. 29, 2021 (JP) ..... 2021-193141

(51) Int. Cl.
*F28D 9/00* (2006.01)
*F28F 3/08* (2006.01)
*F28F 3/10* (2006.01)

(52) U.S. Cl.
CPC ..... *F28F 3/10* (2013.01); *F28D 9/0037* (2013.01); *F28D 9/005* (2013.01); *F28D 9/0075* (2013.01); *F28F 3/086* (2013.01)

(58) Field of Classification Search
CPC ..... F28D 9/0037; F28D 9/005; F28D 9/0075; F28F 3/08; F28F 3/10; F28F 3/025; F28F 3/086
See application file for complete search history.

(56) References Cited

U.S. PATENT DOCUMENTS 5,511,612 A * 4/1996 Tajima ..... F28D 9/0012 165/906
6,182,746 B1 * 2/2001 Wiese ..... F28D 9/005 228/183

(Continued)

FOREIGN PATENT DOCUMENTS

JP 10-185462 A 7/1998
JP 2001-50673 A 2/2001

(Continued)

OTHER PUBLICATIONS

International Search Report (PCT/ISA/210) dated Jan. 17, 2023, issued by the International Searching Authority in International Application No. PCT/JP2022/044642.

(Continued)

*Primary Examiner* — Eric S Ruppert
*Assistant Examiner* — Hans R Weiland
(74) *Attorney, Agent, or Firm* — Sughrue Mion, PLLC

(57) ABSTRACT

This cup-plate type heat exchanger has a lower end plate 2 that is thicker than each of second plates 5. In a state in which plates 2, 3, and 5 are stacked, each of inner fins 4 is provided between the lower end plate 2 and the first plate 3 fitted inside the lower end plate and between the second plate 5 and the first plate 3 fitted inside the second plate, and an angle α of a first inclined portion 6 of the lower end plate 2 is formed smaller than an angle β of a first inclined portion 8 of each of the second plates 5.

4 Claims, 5 Drawing Sheets

(56) References Cited

U.S. PATENT DOCUMENTS

| | | | | |
|---|---|---|---|---|
| 2005/0241814 | A1* | 11/2005 | Hendrix | F28D 9/005 165/167 |
| 2014/0352934 | A1* | 12/2014 | Barone | F28F 9/002 165/166 |
| 2015/0211810 | A1* | 7/2015 | Meguriya | F28D 9/02 165/166 |
| 2016/0214215 | A1* | 7/2016 | Wakamatsu | F28D 9/0043 |
| 2021/0018277 | A1* | 1/2021 | Lee | F28F 3/046 |
| 2022/0390182 | A1* | 12/2022 | Zhang | F28D 9/005 |

FOREIGN PATENT DOCUMENTS

| | | | | |
|---|---|---|---|---|
| JP | 2005-530979 | A | 10/2005 | |
| JP | 2019-70474 | A | 5/2019 | |
| JP | 2019070474 | A * | 5/2019 | |
| SE | 526031 | C2 * | 6/2005 | F28D 9/005 |

OTHER PUBLICATIONS

Written Opinion (PCT/ISA/237) dated Jan. 17, 2023, issued by the International Searching Authority in International Application No. PCT/JP2022/044642.

* cited by examiner

CUP-PLATE TYPE HEAT EXCHANGER

CROSS-REFERENCE TO RELATED APPLICATIONS

This application is a National Phase Entry of PCT International Application No. PCT/JP2022/044642 filed on Nov. 25, 2022, which claims priority to Japanese Patent Application No. 2021-193141 filed on Nov. 29, 2021, the contents of all of which are incorporated herein by reference in their entirety.

TECHNICAL FIELD

The present invention mainly relates to an optimal cup-plate type heat exchanger in which an oil flow passage and a cooling water flow passage are alternately formed between plates.

BACKGROUND ART

As a cup-plate type heat exchanger in the related art, those described in Patent Literature 1 and Patent Literature 2 below are known.

In these cup-plate type heat exchangers, dish-shaped plates are stacked, an oil flow passage and a cooling water flow passage are alternately formed between the plates, inner fins are arranged in the oil flow passage, and heat is exchanged between high-temperature oil and cooling water.

CITATION LIST

Patent Literature

Patent Literature 1: JPH10-185462A
Patent Literature 2: JP2019-70474A

SUMMARY OF INVENTION

Technical Problem

In such a heat exchanger, in the related art, for example, as shown in FIG. 5, a relatively thick lower end plate 2*a* is provided on a base plate, and a first plate 3*a* and a second plate 5*a* are alternately provided on the lower end plate 2*a*.

The thickness of the lower end plate 2*a* located at the lowest end is made larger than that of the second plate 5*a* to maintain strength. However, when the thickness increases, the workability deteriorates. Therefore, the radius of curvature of the bent portion between the base plane surface and the outer peripheral wall of the lower end plate 2*a* is larger than that of the other plates, and the installation surface for an inner fin 4*a* is correspondingly smaller than that on the second plate 5*a*.

That is, since the radius of curvature of the lower end plate 2*a* is larger than that of the second plate 5*a*, in FIG. 5, a boundary A between the base plane surface and the outer peripheral wall of the lower end plate 2*a* is moved closer to the center of the plate than is a boundary B between the base plane surface and the outer peripheral wall of the second plate 5*a*.

On the other hand, it is desirable to provide the inner fin 4*a* in a wide range, and it is desirable that the inner fin 4*a* be common in each stage.

Therefore, the object of the present invention is to secure an installation area for an inner fin equivalent to that of other cup plates even in a thick cup plate.

Solution to Problem

The present invention according to claim 1 is a cup-plate type heat exchanger being formed of a stacked body of plates each of which is inclined upward from a center toward an outer periphery as a whole on an entire peripheral edge of a base plane surface 1, in which each of first plates 3 and each of second plates 5 are alternately stacked in an intermediate portion in a stack direction, in which each of the first plates 3 includes a first vertical portion 7 that rises substantially parallel to a perpendicular line L that is to stand on the base plane surface 1 from a periphery of the base plane surface 1, an inclined portion 8 that is inclined outward from a periphery of the first vertical portion 7 thereof at an acute angle β with respect to the perpendicular line L, and a second vertical portion 7 that rises substantially parallel to the perpendicular line L from an edge of the inclined portion 8 thereof, in which each of the second plates 5 includes a first inclined portion 8 that is inclined outward at the acute angle β with respect to the perpendicular line L that is to stand on the periphery of the base plane surface 1, a vertical portion 7 that rises substantially parallel to the perpendicular line L from an edge of the first inclined portion 8 thereof, and a second inclined portion 8 that is inclined outward from an edge of the vertical portion 7 thereof at the acute angle β with respect to the perpendicular line L, and in which the vertical portions 7 and the inclined portions 8 of the two plates 3, 5 are aligned and stacked, in which a lower end plate 2 that is thicker than each of the second plates 5 is provided at a lower end in the stack direction, in which the lower end plate 2 includes a first inclined portion 6 that is inclined outward from the periphery of the base plane surface 1 at an acute angle α with respect to the perpendicular line L that is to stand on the base plane surface 1, a vertical portion 7 that rises substantially parallel to the perpendicular line L from an edge of the first inclined portion 6 thereof, and a second inclined portion 8 that is inclined outward from an edge of the vertical portion 7 thereof at the acute angle β with respect to the perpendicular line L, in which, in a state in which the plates 2, 3, 5 are stacked, each of inner fins 4 is provided between the lower end plate 2 and the first plate 3 fitted inside the lower end plate 2 and between the second plate 5 and the first plate 3 fitted inside the second plate 5, and in which the angle α of the first inclined portion 6 of the lower end plate 2 is formed smaller than the angle β of the first inclined portion 8 of each of the second plates 5.

Advantageous Effects of Invention

In the cup-plate type heat exchanger according to the present invention, in the state in which the plates 2, 3, 5 are stacked, the inner fin 4 is provided between the lower end plate 2 and the first plate 3 fitted inside the lower end plate 2 and between the second plate 5 and the first plate 3 fitted inside the second plate 5, and the angle α of the first inclined portion 6 of the lower end plate 2 is formed smaller than the angle β of the first inclined portion 8 of the second plate 5.

Accordingly, the installation area for the inner fin 4 between the lower end plate 2 and the first plate 3 fitted inside the lower end plate 2 is increased, and the installation area for the inner fin 4 equivalent to that between the second plate 5 and the first plate 3 fitted inside the plate 5 can be secured.

DESCRIPTION OF EMBODIMENTS

Hereinafter, an embodiment of the present invention will be described with reference to the drawings.

Figure 1:
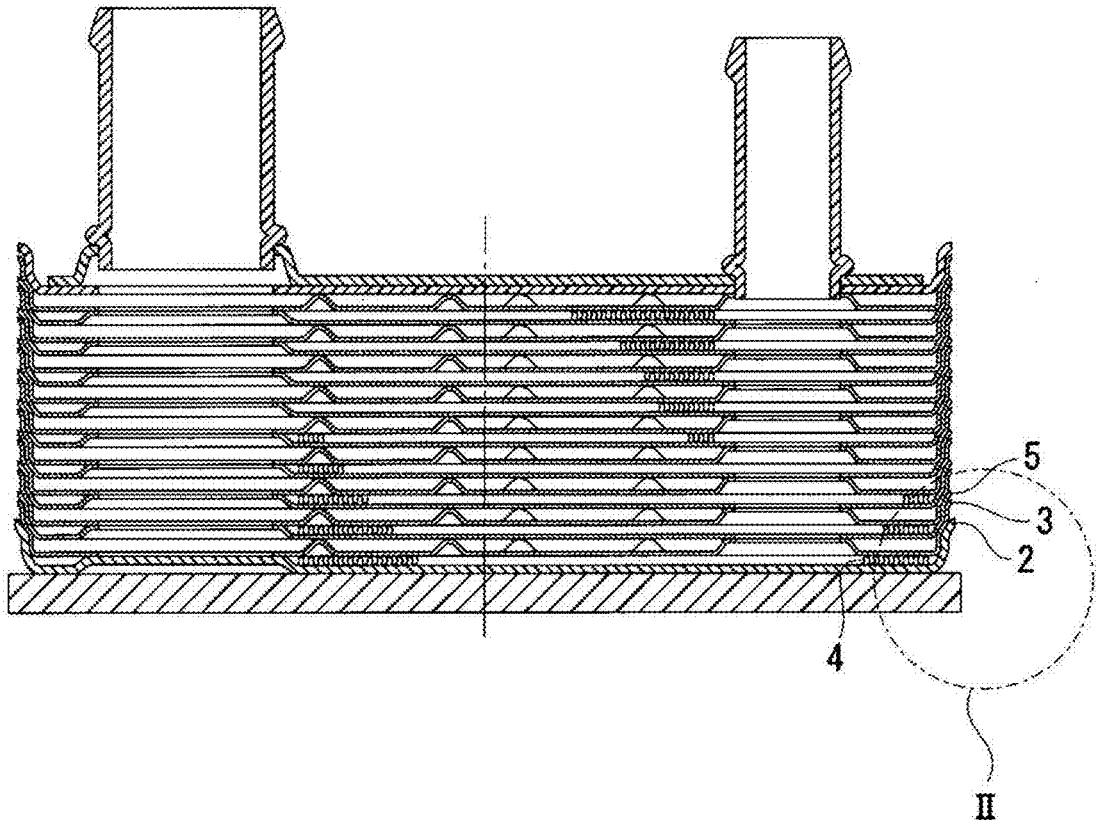
FIG. 1 is a cross-sectional view of a heat exchanger according to the present invention.
Figure 2:
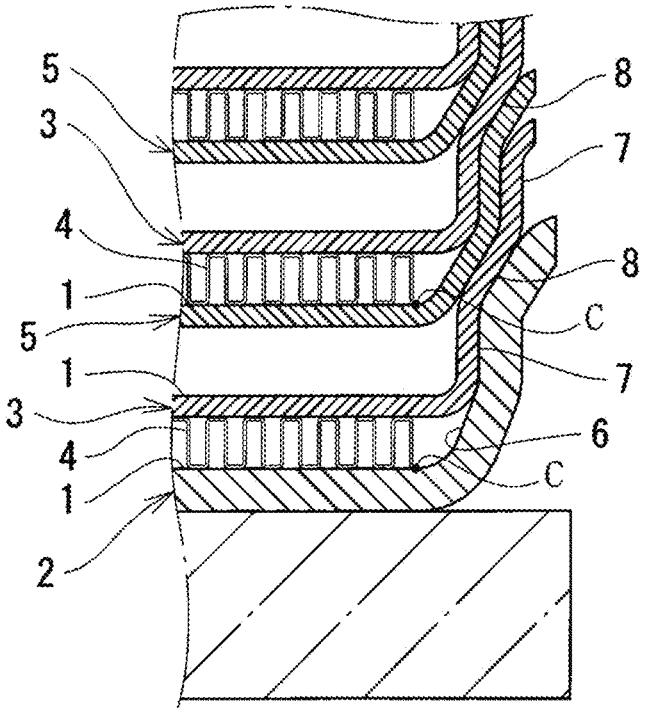
FIG. 2 is an enlarged view of a portion II in FIG. 1.

FIG. 1 is a cross-sectional view of a heat exchanger according to the present invention, and FIG. 2 is an enlarged view of a portion II in FIG. 1.

Figure 3:
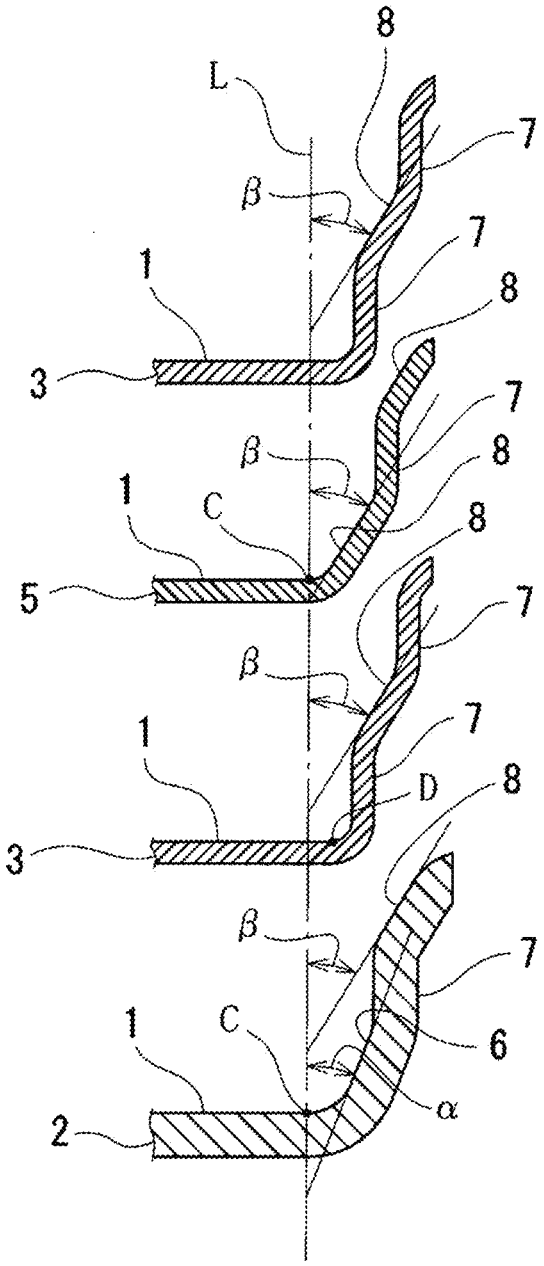
FIG. 3 is an exploded view of the main part of a cup plate that constitutes the heat exchanger.
Figure 4:
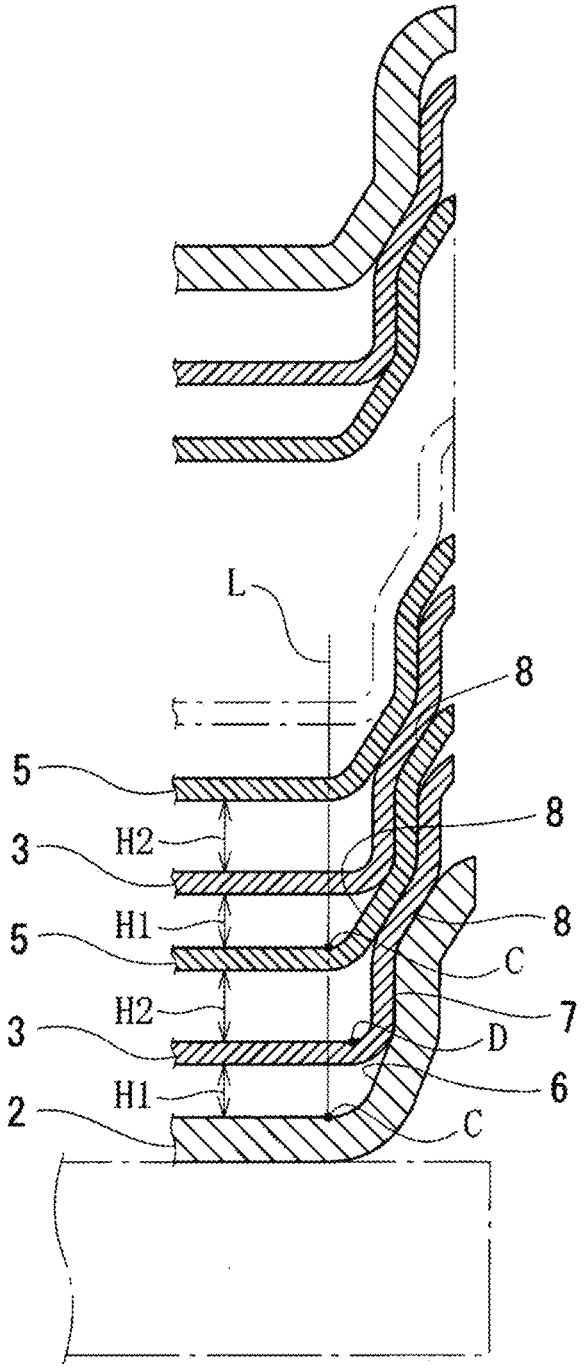
FIG. 4 is an explanatory view showing the assembled state of the heat exchanger.

FIG. 3 is an exploded view of the main part of a cup plate that constitutes the heat exchanger, and FIG. 4 is a vertical cross-sectional view of the main part showing the assembled state of the heat exchanger.

As shown in FIGS. 1 and 2, the heat exchanger is formed of a stacked body of plates that are inclined upward from the center toward the outer periphery as a whole on the entire peripheral edge of a base plane surface 1, and a first plate 3 and a second plate 5 are alternately stacked in the intermediate portion in the stack direction.

In this example, the first plate 3 and the second plate 5 have the same thickness.

As shown in FIG. 3, the first plate 3 is formed with a first vertical portion 7 that rises substantially parallel to a perpendicular line L from the edge portion of the base plane surface 1. An inclined portion 8 is formed that is inclined outward from the edge portion of the first vertical portion 7 at an acute angle β with respect to the perpendicular line L. Next, a second vertical portion 7 is formed that rises substantially parallel to the perpendicular line L from the edge of the inclined portion 8.

The first vertical portion 7, the inclined portion 8, and the second vertical portion 7 of the first plate 3 are continuous, and form a wall surface that is inclined stepwise via the inclined portion 8.

As shown in FIG. 3, the second plate 5 is formed with a first inclined portion 8 that is inclined outward from the edge portion of the base plane surface 1 at the acute angle β with respect to the perpendicular line L. Next, the vertical portion 7 is formed that rises substantially parallel to the perpendicular line L from the edge of the first inclined portion 8. Next, a second inclined portion 8 is formed that is inclined outward from the edge of the vertical portion 7 at the acute angle β with respect to the perpendicular line L.

The first inclined portion 8, the vertical portion 7, and the second inclined portion 8 of the second plate 5 are also continuous, and form a wall surface that is inclined stepwise via the vertical portion 7.

A lower end plate 2 is provided at the lower end in the stack direction.

As shown in FIG. 3, the lower end plate 2 of the heat exchanger according to this embodiment is thicker than the second plate 5.

The lower end plate 2 is formed with a first inclined portion 6 that is inclined outward from the edge portion of the base plane surface 1 at an acute inclination angle α with respect to the perpendicular line L rising therefrom. Next, the vertical portion 7 is formed that rises substantially parallel to the perpendicular line L from the edge portion of the first inclined portion 6. Next, the second inclined portion 8 is formed that is inclined outward from the edge portion of the vertical portion 7 at the acute angle β with respect to the perpendicular line L.

The first inclined portion 6, the vertical portion 7, and the second inclined portion 8 of the lower end plate 2 are also continuous, and form a wall surface that is inclined stepwise via the vertical portion 7.

As shown in FIGS. 2 and 4, the vertical portions 7 and the inclined portions 8 of the lower end plate 2, the first plate 3, and the second plate 5 are aligned and stacked.

In this example, the inclination angle β of the second inclined portion 8 of the lower end plate 2 is substantially the same as the inclination angle β of the inclined portion 8 of the first plate 3 adjacent to the plate 2.

As shown in FIGS. 2 and 4, in a layer in which the first plate 3 is fitted inside the lower end plate 2 and a layer in which the first plate 3 is fitted inside the second plate 5, a first flow passage H1 is formed, and an inner fin 4 is provided therein.

A second flow passage H2 is formed in a layer in which the second plate 5 is fitted inside the first plate 3.

As an example, oil is supplied to the first flow passage H1 including the inner fin 4, and cooling water is supplied to the second flow passage H2.

Figure 5:
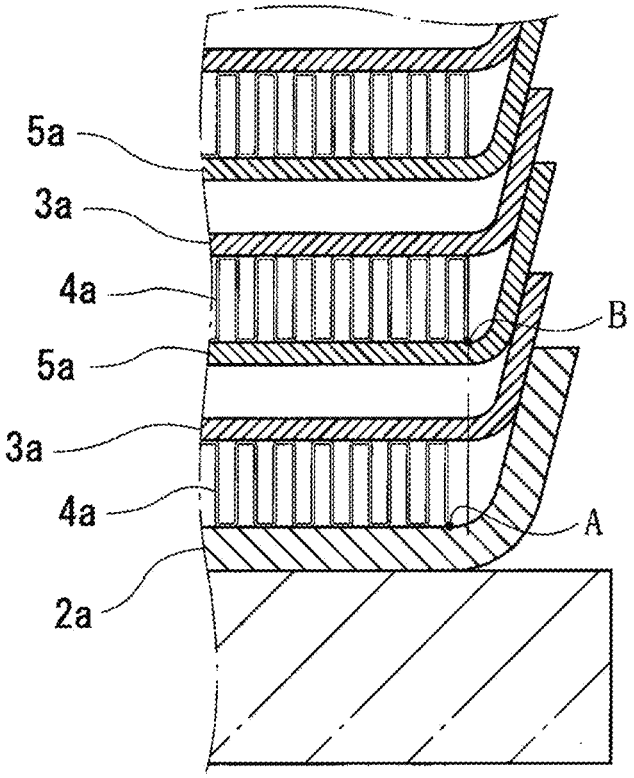
FIG. 5 RELATED ART
FIG. 5 is a cross-sectional view of the main part of a heat exchanger in the related art.

In this basic form, since the lower end plate 2*a* has a large thickness, it is necessary to increase the radius of curvature when the wall surface is raised. Therefore, in the related art, as shown in FIG. 5, the boundary A of the base plane surface of the lower end plate 2*a* is located inside the boundary B of the base plane surface of the second plate 5*a*, and the installation area for the inner fin 4*a* on the lower end plate 2*a* is smaller than the installation area for the inner fin 4*a* on the second plate 5*a*.

On the other hand, in this embodiment, as shown in FIG. 3, the inclination angle α of the first inclined portion 6 of the lower end plate 2 is made smaller than the angle β of the first inclined portion 8 of the second plate 5. Accordingly, a boundary C of the base plane surface 1 of the lower end plate 2 and a boundary C of the base plane surface 1 of the second plate 5 are adjusted such that the boundary C of the base plane surface 1 of the lower end plate 2 and the boundary C of the base plane surface 1 of the second plate 5 are located on the same perpendicular line L.

Accordingly, as shown in FIG. 2, the installation area for the inner fin 4 between the lower end plate 2 and the first plate 3 fitted inside the lower end plate 2 is increased, and the installation area for the inner fin 4 equivalent to that between the second plate 5 and the first plate 3 fitted inside the plate 5 can be secured.

INDUSTRIAL APPLICABILITY

The cup-plate type heat exchanger according to the present invention is not limited to being used for an oil cooler, and can be used for various heat exchangers.

REFERENCE SIGNS LIST

1 base plane surface
2 lower end plate

3 first plate
4 inner fin
5 second plate
6 inclined portion
7 vertical portion
8 inclined portion
2*a* lower end plate
3*a* first plate
4*a* inner fin
5*a* second plate
L perpendicular line
α angle
β angle
A boundary
B boundary
C boundary
D boundary
H1 first flow passage
H2 second flow passage

The invention claimed is:

1. A cup-plate type heat exchanger being formed of a stacked body of plates each of which is inclined upward from a center toward an outer periphery as a whole on an entire peripheral edge of a base plane surface (1), in which each of first plates (3) and each of second plates (5) are alternately stacked in an intermediate portion in a stack direction, in which each of the first plates (3) includes a first vertical portion (7) that rises substantially parallel to a perpendicular line (L) that is to stand on the base plane surface (1) from a periphery of the base plane surface (1), an inclined portion (8) that is inclined outward from a periphery of the first vertical portion (7) thereof at an acute angle (β) with respect to the perpendicular line (L), and a second vertical portion (7) that rises substantially parallel to the perpendicular line (L) from an edge of the inclined portion (8) thereof, in which each of the second plates (5) includes a first inclined portion (8) that is inclined outward at the acute angle (β) with respect to the perpendicular line (L) that is to stand on the periphery of the base plane surface (1), a vertical portion (7) that rises substantially parallel to the perpendicular line (L) from an edge of the first inclined portion (8) thereof, and a second inclined portion (8) that is inclined outward from an edge of the vertical portion (7) thereof at the acute angle (β) with respect to the perpendicular line (L), and in which the vertical portions (7) and the inclined portions (8) of the two plates (3, 5) are aligned and stacked, wherein a lower end plate (2) that is thicker than each of the second plates (5) is provided at a lower end in the stack direction, wherein the lower end plate (2) includes a first inclined portion (6) that is inclined outward from the periphery of the base plane surface (1) at an acute angle (α) with respect to the perpendicular line (L) that is to stand on the base plane surface (1), a vertical portion (7) that rises substantially parallel to the perpendicular line (L) from an edge of the first inclined portion (6) thereof, and a second inclined portion (8) that is inclined outward from an edge of the vertical portion (7) thereof at the acute angle (β) with respect to the perpendicular line (L), wherein, in a state in which the plates (2, 3, 5) are stacked, each of inner fins (4) is provided between the lower end plate (2) and the first plate (3) fitted inside the lower end plate (2) and between the second plate (5) and the first plate (3) fitted inside the second plate (5), and wherein the angle (α) of the first inclined portion (6) of the lower end plate (2) is formed smaller than the angle (β) of the first inclined portion (8) of each of the second plates (5).

2. The heat exchanger according to claim 1, wherein one of the first plates (3) directly contacts the lower end plate (2).

3. The heat exchanger according to claim 1, wherein a curved portion connects the base plane surface (1) and the first inclined portion (6) of the lower end plate (2).

4. The heat exchanger according to claim 3, wherein one of the first plates (3) directly contacts the lower end plate (2).

* * * * *